US007005803B2

(12) United States Patent
Abiko

(10) Patent No.: US 7,005,803 B2
(45) Date of Patent: Feb. 28, 2006

(54) ILLUMINATOR

(75) Inventor: Akio Abiko, Tokyo (JP)

(73) Assignee: Digital Alliance Co., Ltd., Tokyo (JP)

( * ) Notice: Subject to any disclaimer, the term of this patent is extended or adjusted under 35 U.S.C. 154(b) by 10 days.

(21) Appl. No.: 10/785,308

(22) Filed: Feb. 24, 2004

(65) Prior Publication Data

US 2005/0134184 A1 Jun. 23, 2005

(30) Foreign Application Priority Data

Dec. 22, 2003 (JP) ..... 2003-425323

(51) Int. Cl.
*H01J 7/44* (2006.01)
*H01J 17/20* (2006.01)

(52) U.S. Cl. ..... 315/56; 313/573

(58) Field of Classification Search ..... 315/56, 315/169.1, 169.3, 169.4; 313/493, 639, 573, 313/492

See application file for complete search history.

(56) References Cited

U.S. PATENT DOCUMENTS 5,319,282 A * 6/1994 Winsor ..... 315/169.4
5,466,990 A * 11/1995 Winsor ..... 315/56
5,866,994 A 2/1999 Nakano
6,036,334 A 3/2000 Nakano
6,127,780 A * 10/2000 Winsor ..... 315/56
6,396,081 B1 * 5/2002 Tews et al. ..... 257/79
6,871,972 B1 * 3/2005 Ju ..... 362/26

* cited by examiner

*Primary Examiner*—Wilson Lee
*Assistant Examiner*—Minh Dieu A
(74) *Attorney, Agent, or Firm*—Richard M. Goldberg

(57) ABSTRACT

An illuminator capable of increasing the service life of discharge tubes, includes a pair of an ultraviolet light-emitting discharge tube and a white visible light-emitting discharge tube that are alternately and periodically placed in a lighted state and an unlighted state, such that a state of illumination using only one of the discharge tubes is realized in at least part of a time domain during the repetition period. The illuminator includes a hot-cathode tube used for at least one of the discharge tubes, the hot-cathode tube being arranged in a state where a heating power supply for heating filaments, and an illuminating power supply for enabling motion of thermoelectrons within the hot-cathode tube and at the same time periodic repetition of the lighted state and unlighted state, are capable of executing and interrupting application of voltage, independently of each other.

3 Claims, 5 Drawing Sheets

ILLUMINATOR

BACKGROUND OF THE INVENTION

1. Field of the Invention

The present invention relates to an illuminator that illuminates an object, such as a picture, a poster, a sculpture, or the like, which is capable of showing particular colors in response to ultraviolet light.

2. Description of the Related Art

Recently, a coating material is produced which emits or reflects white visible light within a predetermined wavelength region in response to irradiation of ultraviolet light. When an object for appreciation, such as a picture, a poster, a sculpture, or the like, is coated with the coating material, and irradiated with ultraviolet light, colors different from original colors of the object are caused to appear so as to cause the object to emerge in a varied status before an appreciator or a viewer.

Further, there has been proposed an illuminator configured such that the white visible light and ultraviolet light are repeatedly and periodically turned on and off in order to cause the object to alternately appear in a state for appreciation, as described above, wherein the colors of the object are changed by using ultraviolet light as a light source, and in an original state by irradiation with white light, thereby realizing a state of irradiation of an object with either of white visible light and ultraviolet light and/or a state of irradiation of the same with both of them.

The proposed illuminator constructed as above is usually configured to employ filaments that emit thermoelectrons, for light sources for ultraviolet light and the white visible light. However, due to the periodic supply of the electric power to the filaments for the purpose of the periodic irradiation described above, metal of the filaments is repeatedly vaporized and restored to its original state, which causes each filament to undergo a change in the multilayer metal structure thereof, so that the service life of the filament is inevitably shortened.

However, there has never been proposed any illuminator that provides an improvement in the service life of discharge tubes over the above-described conventional illuminator.

SUMMARY OF THE INVENTION

It is an object of the present invention to provide an illuminator that illuminates an object for appreciation with both of ultraviolet light and white visible light, which is configured to be capable of maintaining the service life of a discharge tube that includes filaments for emitting thermoelectrons and is used as a light source for ultraviolet light or a light source for white visible light.

To attain the above object, the present invention provides an illuminator including a pair of an ultraviolet light-emitting discharge tube and a white visible light-emitting discharge tube that are alternately and periodically placed in a lighted state and an unlighted state, such that a state of illumination using only one of the ultraviolet light-emitting discharge tube and the white visible light-emitting discharge tube is realized in at least part of a time domain during the repetition period, the illuminator comprising a hot-cathode tube used for at least one of the ultraviolet light-emitting discharge tube and the white visible light-emitting discharge tube, the hot-cathode tube being arranged in a state where a heating power supply for heating filaments, and an illuminating power supply for enabling motion of thermoelectrons within the hot-cathode tube and at the same time periodic repetition of the lighted state and unlighted state, are capable of executing and interrupting application of voltage, independently of each other.

BRIEF DESCRIPTION OF THE DRAWINGS

FIGS. 2(*a*) and 2(*b*) are graphs showing how ultraviolet light and white visible light are periodically changed, in which:

FIG. 2(*a*) shows a case where ultraviolet light and white visible light do not overlap each other, and ultraviolet light is instantaneously changed, and FIG. 2(*b*) shows a case where ultraviolet light and white visible light partially overlap each other, and both ultraviolet light and white visible light are progressively changed (wherein $I_w$ represents the amount of white visible light, and $I_{uv}$ represents the amount of ultraviolet light);

FIGS. 3(*a*) and 3(*b*) are graphs showing an example of pulse width modulation, and changes in the amount of light generated by carrying out the pulse width modulation, in which:

FIG. 3(*a*) shows a state of electric input by the pulse width modulation, and FIG. 3(*b*) shows changes in the amount of light generated by the pulse width modulation (Vi represents the amount of power supply, and I represents the amount of light);

DETAILED DESCRIPTION OF THE INVENTION

In the construction of the present invention as a solution to the above problem, as the light source for ultraviolet light, there is often employed a conventional ultraviolet light-emitting discharge tube in which thermoelectrons generated from filaments are caused to collide with mercury in the discharge tube by an electric field generated in the discharge tube.

Similarly, as the light source for white visible light, there is often employed a discharge tube based on the principle of a so-called fluorescent tube where ultraviolet light is generated by the same principle as that of ultraviolet light-emitting discharge tube, and then white visible light is generated by a coating material coated on an inner wall of the discharge tube.

Figure 1:
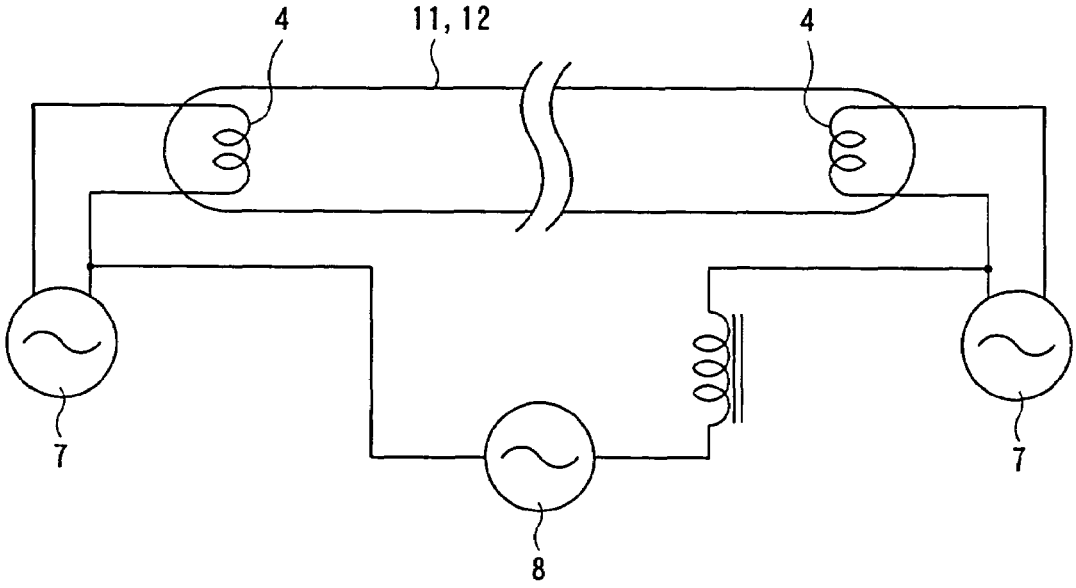
FIG. 1 is a sectional side elevation showing the basic construction of a discharge tube according to the present invention.

In the present invention, as shown in FIG. 1, for one or each of ultraviolet light-emitting discharge tube and white visible light-emitting discharge tube (fluorescent tube), there is employed a hot-cathode tube 11 in which heating power supplies 7 are arranged for heating filaments 4, in a state where the application of voltages from the heating power supplies 7 to the filaments 4 can be executed and interrupted independently of an irradiation power supply 8 which enables thermoelectrons generated from the filaments to move within the tube.

Although FIG. 1 illustrates a state in which the irradiation power supply 8 and the heating power supplies 7 are both connected to the filaments 4, it is possible to employ a construction for causing the irradiation power supply 8 to be connected to electrodes disposed separately or independently of the filaments 4, since the thermoelectrons have already been emitted from the filaments by the operation of the heating power supplies 7. This construction makes it possible to further increase the service life of the filaments 4.

As described above, the heating power supplies 7 for heating the respective filaments 4 are arranged in a manner capable of independently executing and interrupting the application of voltages to the respective filaments 4, whereby each filament 4 is held in a continuously heated state, while power supply from the irradiation power supply 8 is periodically turned on and off. This makes it possible to prevent the degradation of capability of the filament 4 due to repeated vaporization and restoration of the metal of the filament 4, and further ensure longer life of a hot-cathode tube 11 for ultraviolet light or a hot-cathode tube 11 for white visible light.

Although in FIG. 1, AC power supplies are used as the heating power supplies 7 for heating the filaments 4, DC power supplies may be used as the heating power supplies 7.

When ultraviolet light-emitting discharge tube and white visible light-emitting discharge tube are periodically lighted to illuminate an object, only one of ultraviolet light and white visible light is irradiated in some parts of the periodic time domain. It is possible to employ a configuration where only one of ultraviolet light and white visible light is irradiated on the object without exception, as shown in FIG. 2(*a*), and a configuration where ultraviolet light and white visible light partially overlap each other, as shown in FIG. 2(*b*).

Figure 2A:
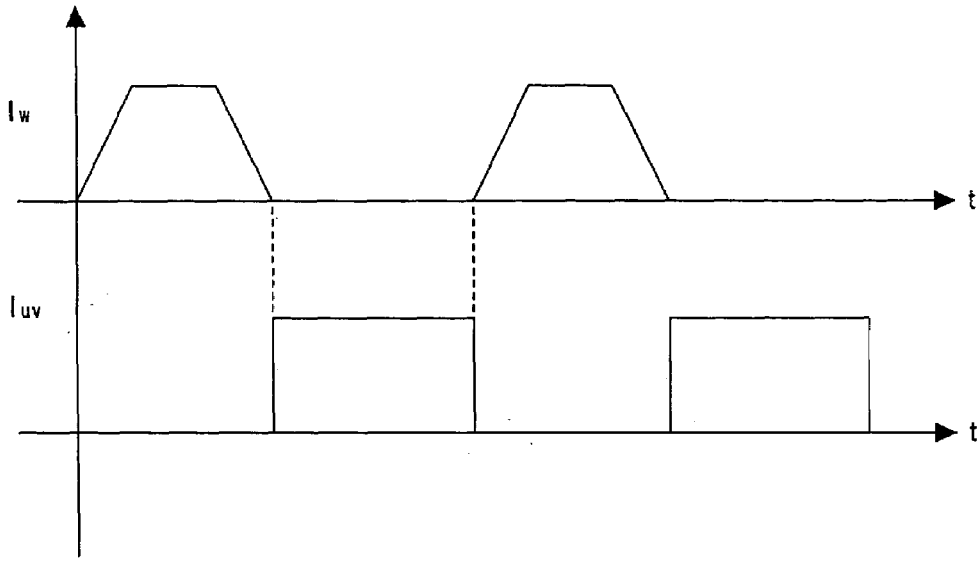
Figure 2B:
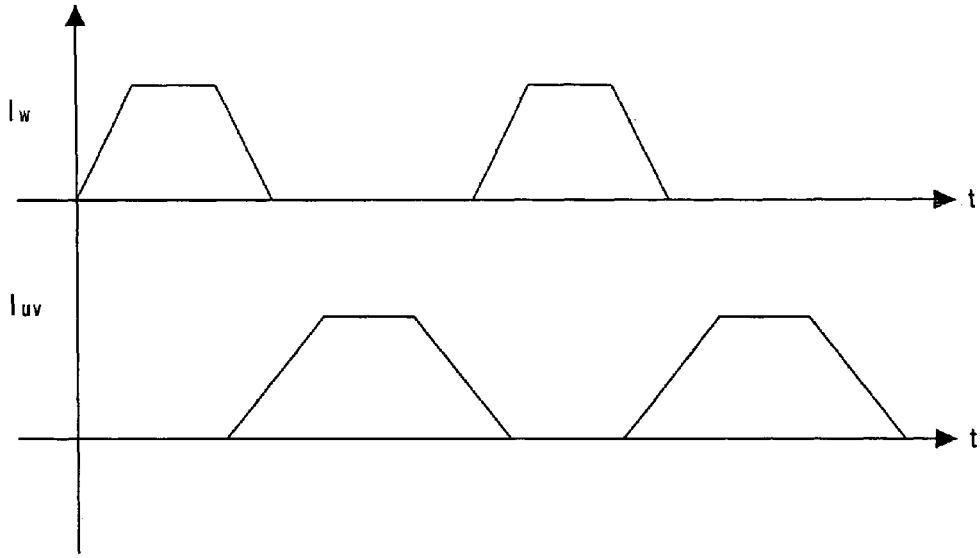

In the case of FIG. 2(*a*), ultraviolet light-emitting discharge tube is instantaneously changed between an ON state and an OFF state thereof, whereas white visible light-emitting discharge tube is progressively changed between an ON state and an OFF state thereof. These changes make it possible to realize a progressive change in the impression of a whole image of the object, using white visible light affecting the lightness or darkness of the whole image, similarly to a change in the daytime and nighttime in daily life, and realize variations in the impression of particular portions of the whole image by changes in colors thereof, using the ultraviolet ray often used for causing light emission from such particular portions of the whole image.

In the case of FIG. 2(*b*), each of ultraviolet light-emitting discharge tube and white visible light-emitting discharge tube is progressively changed between the ON state and the OFF state thereof. These changes make it possible to realize a mild change in the impression of the object.

Figures 3A, 3B:
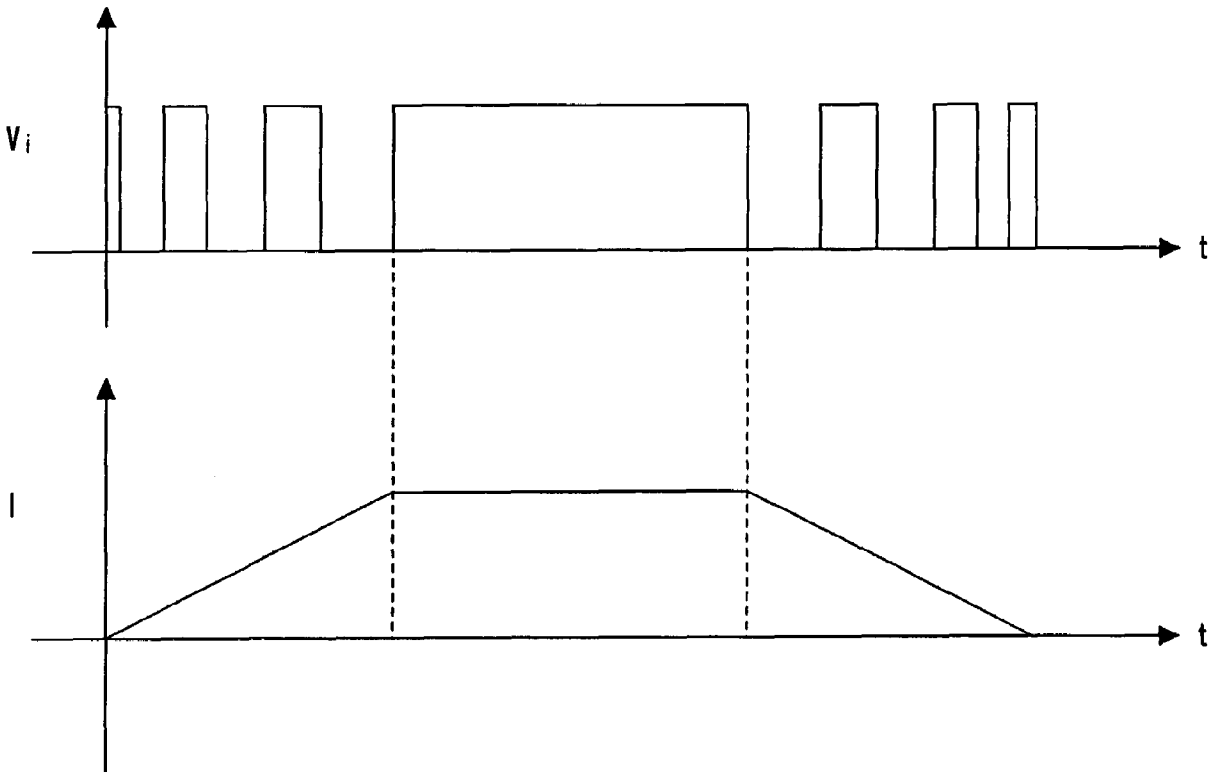

The instantaneous change between the ON state and the OFF state, as shown in FIG. 2(*a*), can be effected simply by turning on and off associated switches. To cause the progressive change between the ON state and the OFF state, the pulse width modulation of power to be supplied may be carried out, as shown in FIG. 3(*a*), to thereby change the amount of light generated, as shown in FIG. 3(*b*).

The above progressive change can be implemented not only by the pulse width modulation but also e.g. by a method for modulating phases of photo voltage and photo current in the varying time domain.

The cold-cathode tubes 12 are employed as light sources having no independent heating power supplies 7 arranged therein.

Figure 6:
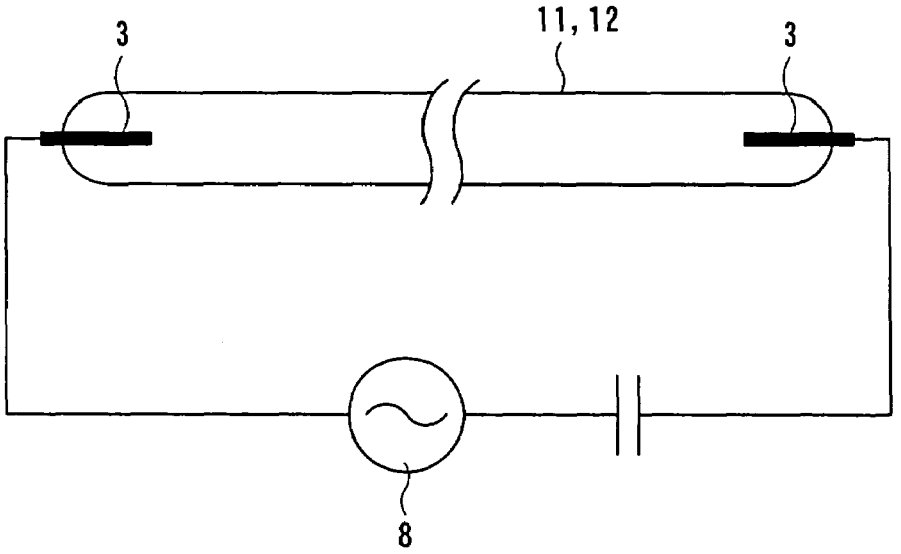
FIG. 6 is a sectional side elevation showing the basic construction of a cold-cathode tube.

The cold-cathode tubes 12 have a plate-like shape, a stick-like shape, or a hollow cylindrical shape. Referring to FIG. 6, the cold-cathode tube 12 is based on a principle that electrons are generated by applying a high voltage to electrodes 3 at opposite ends of the cold-cathode tube 12 without using any filaments or preheating the electrodes 3, and moved in the tube at a high speed to collide with argon gas to thereby cause positive ions grown by ionization growth to collide with a cathode, whereby secondary electrons are emitted from the cathode to perform discharge, and the released electrons collide with mercury (Hg) atoms within the tube, causing the mercury to irradiate ultraviolet light.

Normally, although the cold-cathode tube 12 is used as a light source for white visible light, by causing ultraviolet light to excite a fluorescent material coated on an inner wall of the cold-cathode tube, the cold-cathode tube 12 can be used as a light source for ultraviolet light, without providing the coating of the fluorescent material on the inner wall thereof.

The cold-cathode tube 12 is distinguished from the hot-cathode tube 11 in that thermoelectrons themselves do not contribute to the emission of secondary electrons. However, the cold-cathode tube 12 has a simple electrode structure, and therefore it can be configured to have a small-sized tube structure. This makes it possible to realize a high efficiency of light emission by causing a predetermined amount of visible light to be emitted with reduced power consumption, and make longer the service life of the cold-cathode tube 12 as the discharge tube than that of the hot-cathode tube 11, even if power supply thereto is periodically turned on and off.

Further, the cold-cathode tube 12 generates a small amount of heat so that there is no need to use a heat-resistant material for an object for appreciation, which makes it possible to employ a wider range of materials, such as thermoplastic resins.

Normally, the cold-cathode tube 12 is instantaneously started by instantaneously applying a high voltage thereto without preheating the electrodes 3. Therefore, it is considered to be difficult for the cold-cathode tube 12 to emit light in a manner corresponding to a voltage lower than a predetermined standard voltage.

Therefore, when the cold-cathode tube 12 is employed, it is suitable to perform the pulse width modulation, as shown in FIGS. 3(*a*) and 3(*b*) (since a low voltage can be applied in the case of the pulse width modulation).

Figure 5:
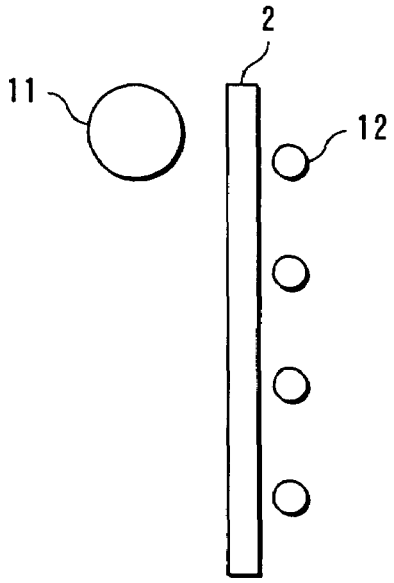
FIG. 5 is a sectional side elevation showing the construction of employing the cold-cathode tubes as backlights.

As shown in FIG. 5, the cold-cathode tubes 12 may be employed as backlights.

In general, the cold-cathode tubes 12 are mainly used as backlights for a liquid crystal display by utilizing its slim shape characteristic. In Embodiment 2, the cold-cathode tubes 12 are arranged in the back of an object for appreciation, by utilizing the characteristic, for both of the light sources for ultraviolet light and white visible light.

With backlight illumination described above, the viewer can appreciate an impression created by the indirect illumination, which is far softer than an impression given by direct illumination from the front surface side of the object.

It should be noted that when the backlight illumination is used for illuminating an object having a three-dimensional structure, such as a sculpture or the like, it is preferable that the inside of the object is hollowed to place the cold-cathode tubes 12 therein as light sources.

Embodiments

Hereinafter, a description will be given based on embodiments.

[Embodiment]

Figure 4:
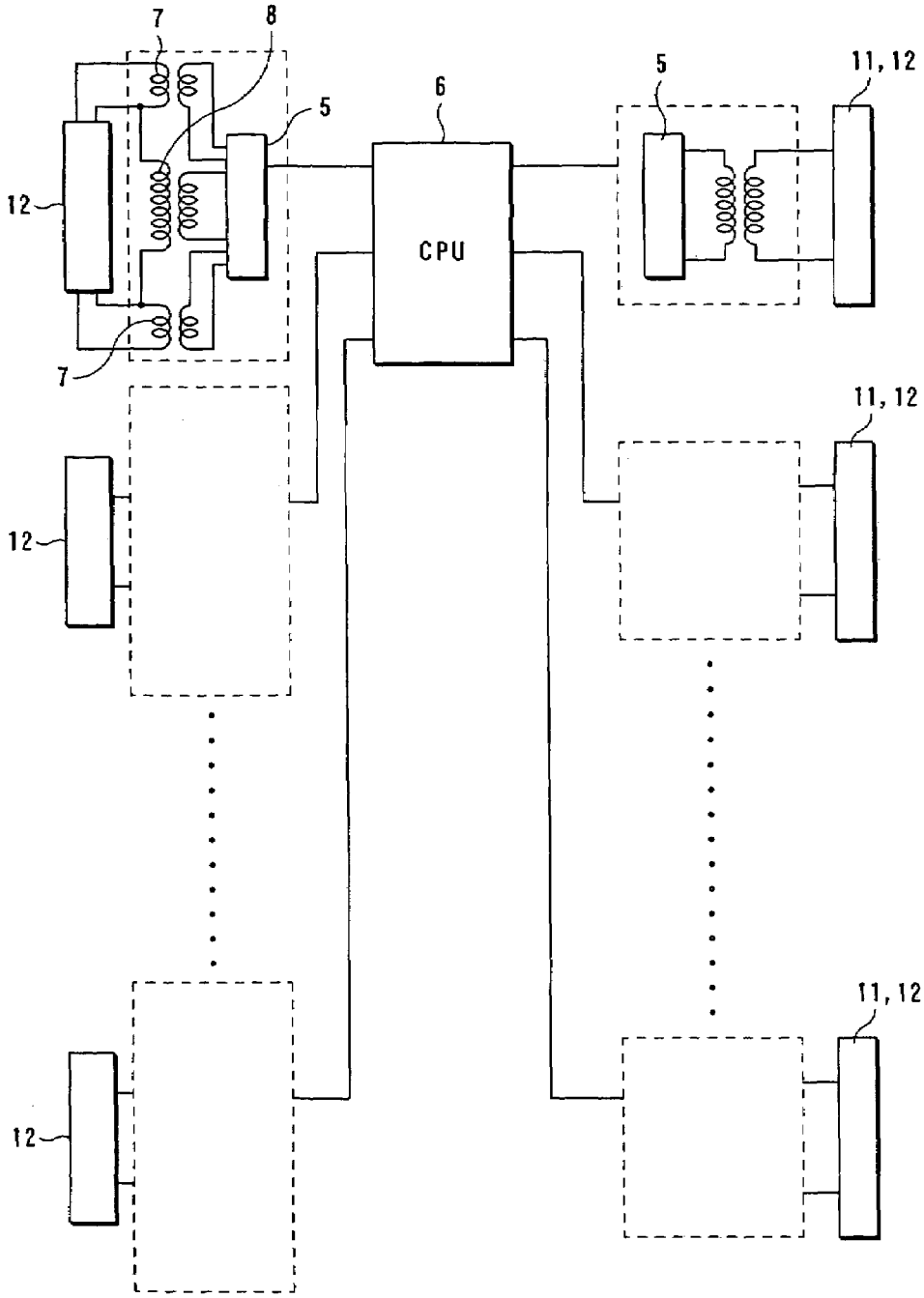
FIG. 4 is a block diagram of an embodiment which selectively uses pairs of light sources, using a computer (CPU)

FIG. 4 shows an embodiment in which a plurality of pairs of light sources for ultraviolet light and white visible light are arranged, and a computer (CPU) 6 controls selection of a pair of light sources and periodic application of voltages from power supplies to the selected pair of light sources. In the above embodiment, it is possible to realize a variety of irradiation states by changing irradiating positions, and the order of irradiations executed therefrom.

Although the irradiating positions and order to be selected are recorded in the computer (CPU) 6, to change the recorded irradiating positions and order, it is necessary to provide instructions from outside. The instructions can be provided from a remote place by using a microcomputer or a remote control unit.

Further, although in FIG. 4, a DC is converted to an AC by an inverter 5 to apply the AC to the irradiation power supply 8, the inverter 5 is not necessarily required, if the original power supply is an AC power supply.

EFFECTS OF THE INVENTION

The illuminator according to the present invention can be widely used not only in exhibition halls, such as an art museum and the like, for exhibiting pictures but also in fields for carrying out demonstrations, such as advertisements using panels, by illumination of light.

According to the illuminator of the present invention, it is possible to increase the service life of discharge tubes as light sources for ultraviolet light or white visible light, in comparison with illuminators according to the prior art, such as those disclosed in the aforementioned Patent Documents 1, 2, and 3, and reduce power consumption particularly when cold-cathode tubes are used as light sources having no independent power supplies for heating filaments, compared with the case of using hot-cathode tubes.

What is claimed is:

1. An illuminator including a pair of an ultraviolet light-emitting discharge tube and a white visible light-emitting discharge tube that are alternately and periodically placed in a lighted state and an unlighted state, such that a state of illumination using only one of said ultraviolet light-emitting discharge tube and said white visible light-emitting discharge tube is realized in at least part of a time domain during a period, the illuminator comprising:

a plurality of pairs of light sources for ultraviolet light and white visible light, a hot-cathode tube used for at least one of said ultraviolet light-emitting discharge tube and said white visible light-emitting discharge tube, said hot-cathode tube being arranged in a state where a heating power supply for heating filaments, and an illuminating power supply for enabling motion of thermoelectrons within said hot-cathode tube and at a same time periodic repetition of the lighted state and unlighted state, are capable of executing and interrupting application of voltage, independently of each other, and a computer which controls selection of a pair of light sources and periodic application of voltages from power supplies to the selected pair of light sources.

2. The illuminator of claim 1, wherein a cold-cathode tube is employed as a discharge tube having no heating power supply arranged therein.

3. The illuminator of claim 2, wherein said cold-cathode tube is used as a backlight.

* * * * *